US008414313B2

(12) United States Patent
Rodrigues et al.

(10) Patent No.: US 8,414,313 B2
(45) Date of Patent: Apr. 9, 2013

(54) SECURITY SHIELD AND TOOL

(75) Inventors: Julio F. Rodrigues, Collierville, TN (US); Timothy Noel Tremba, Cayuta, NY (US)

(73) Assignee: Belden Inc., St. Louis, MO (US)

( * ) Notice: Subject to any disclaimer, the term of this patent is extended or adjusted under 35 U.S.C. 154(b) by 86 days.

(21) Appl. No.: 13/181,123

(22) Filed: Jul. 12, 2011

(65) Prior Publication Data

US 2013/0017694 A1 Jan. 17, 2013

(51) Int. Cl.
*H01R 13/44* (2006.01)

(52) U.S. Cl. ..... 439/133; 439/304; 439/308

(58) Field of Classification Search ..... 439/133–139, 439/304, 308

See application file for complete search history.

(56) References Cited

U.S. PATENT DOCUMENTS

| | | | | |
|---|---|---|---|---|
| 1,762,203 | A * | 6/1930 | Teipel | 439/308 |
| 3,953,097 | A * | 4/1976 | Graham | 439/307 |
| 4,750,898 | A * | 6/1988 | Soulard | 439/301 |
| 5,681,189 | A * | 10/1997 | Dunham | 439/738 |
| 5,723,818 | A * | 3/1998 | Yeh | 174/74 R |
| 5,928,009 | A * | 7/1999 | Lee | 439/131 |
| 6,491,546 | B1 | 12/2002 | Perry | |
| 6,887,102 | B1 | 5/2005 | Burris et al. | |
| 7,086,876 | B1 | 8/2006 | Montena | |
| 7,179,100 | B2 * | 2/2007 | Montena | 439/133 |
| 7,214,095 | B1 | 5/2007 | Mathews | |
| 7,524,208 | B2 | 4/2009 | Mathews | |
| 7,806,706 | B2 * | 10/2010 | Obenshain | 439/133 |
| 2006/0089027 | A1 | 4/2006 | Chawgo et al. | |
| 2006/0252306 | A1 | 11/2006 | Montena | |
| 2010/0022120 | A1 | 1/2010 | Bradley | |
| 2011/0044585 | A1 * | 2/2011 | Seng | 385/60 |
| 2011/0059650 | A1 | 3/2011 | Amidon | |

* cited by examiner

*Primary Examiner* — James Harvey

(74) *Attorney, Agent, or Firm* — Schmeiser, Olsen & Watts LLP

(57) ABSTRACT

Security systems, including shields, adapters, and/or tools, for limiting access to a coaxial cable connector are provided. A shield comprises an outer shield configured to limit access to the coaxial cable connector. The coaxial cable connector comprises a fastener portion that is configured to be rotatable with respect to a body portion of the coaxial cable connector. The shield further comprises an adapter configured to be coupled to the outer shield. The adapter is configured to engage a side of the fastener portion of the coaxial cable connector. The adapter is further configured to engage a tool configured to rotate the adapter such that, when engaged with both the tool and the fastener portion of the coaxial cable connector, the adapter is configured to rotate the fastener portion of the coaxial cable connector upon rotation of the adapter by the tool.

20 Claims, 9 Drawing Sheets

SECURITY SHIELD AND TOOL

BACKGROUND

The present disclosure relates generally to the field of coaxial cable connectors used to connect coaxial cables to various electronic devices such as televisions, antennas, set-top boxes, and other devices. More specifically, the present disclosure relates to security devices configured to limit access to coaxial cable connectors.

Coaxial cable connectors are often used to provide media services to businesses and/or households, such as cable television programming, broadband internet, telephone services, and/or other types of services. Several connectors may be connected to a hub (e.g., trunk line or hard line) of connector ports configured to route or allocate resources over connected coaxial cables. If left unprotected, there is a risk that an unauthorized user may attempt to tamper with the connectors plugged into the hub. For example, an unauthorized user may attempt to unplug a connector in an effort to disrupt the service of a subscriber. Further, the unauthorized user may attempt to plug a different connector and cable into the port in an attempt to obtain services without providing payment to the service provider.

SUMMARY

One embodiment relates to a shield for use with a coaxial cable connector. The shield comprises an outer shield configured to limit access to the coaxial cable connector. The coaxial cable connector comprises a fastener portion that is configured to be rotatable with respect to a body portion of the coaxial cable connector. The shield further comprises an adapter configured to be coupled to the outer shield. The adapter is configured to engage a side of the fastener portion of the coaxial cable connector. The adapter is further configured to engage a tool configured to rotate the adapter such that, when engaged with both the tool and the fastener portion of the coaxial cable connector, the adapter is configured to rotate the fastener portion of the coaxial cable connector upon rotation of the adapter by the tool.

Another embodiment relates to a tool for connecting and disconnecting a coaxial cable connector protected by a security shield from a port. The security shield comprises a sleeve and an adapter having a plurality of adapter protrusions and a plurality of adapter slots between the adapter protrusions. The adapter has an opening formed therein into which a fastener portion of the coaxial cable connector fits such that, when the fastener portion is placed into the opening of the adapter, rotation of the adapter causes corresponding rotation of the fastener portion of the coaxial cable connector. The tool comprises a body comprising a cylindrical portion at least partially surrounding a hollow cylindrical cavity. The body comprises an inner tool diameter that is greater than a maximum diameter of the coaxial cable connector and an outer tool diameter that is less than an inner diameter of the sleeve of the security shield. The tool further comprises a plurality of tool protrusions extending axially from an end of the body. Each of the tool protrusions is configured to fit within one of the adapter slots. The tool is configured to be moved between the sleeve and the coaxial cable connector in an axial direction until the tool protrusions are inserted into the adapter slots. The tool is configured to rotate the adapter through rotation of the tool protrusions against the adapter protrusions.

Another embodiment relates to a security system for use with a coaxial connector. The security system comprises an outer shield configured to limit access to the coaxial cable connector. The coaxial cable connector comprises a fastener portion that is configured to be rotatable with respect to a body portion of the coaxial cable connector. The security system further comprises an adapter configured to be coupled to the outer shield. The adapter has a cavity formed therein into which the fastener portion of the coaxial cable connector can be advanced such that rotation of the adapter causes corresponding rotation of the fastener portion of the coaxial cable connector. The adapter comprises a plurality of adapter projections. The security system further comprises a tool comprising a hollow cylindrical portion and a plurality of tool projections extending axially from an end of the hollow cylindrical portion. The tool is configured to be moved between the outer shield and the coaxial cable connector in an axial direction until the tool projections are inserted between the adapter projections. The tool is configured to rotate the adapter through rotation of the tool projections against the adapter projections.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Referring generally to the figures, security systems, including a shield, adapter, and/or tool, for limiting access to coaxial cable connectors are shown according to various exemplary embodiments. Security systems disclosed herein may allow authorized users (e.g., maintenance personnel of a service provider) to access and remove or tighten the coaxial cable connector by using a special tool configured for use with the security system while making the connector difficult for unauthorized users to access without the tool. Various security systems disclosed herein utilize an adapter configured to engage both the nut of the coaxial cable connector and the tool so that the user can rotate the tool, which results in rotation of the adapter, which in turn results in rotation of the nut of the connector. In some embodiments, security systems disclosed herein may be used in conjunction with coaxial cable connectors where a portion of the connector has a diameter greater than a length across a portion of the connector nut (e.g., a portion of the connector body has a diameter greater than a length between opposing flat sides or edges of the nut), such that it may be difficult for the tool to directly access and rotate the nut. In various embodiments, the security systems disclosed herein may be constructed from durable and/or inexpensive materials.

Figure 1:
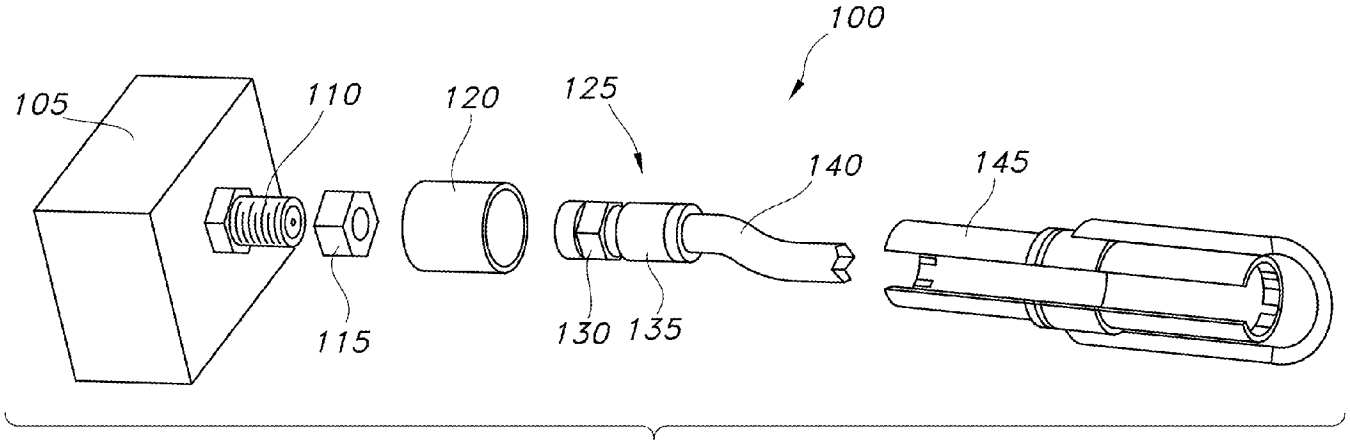
FIG. 1 is a side view of various components of a first security system according to an exemplary embodiment.
Figure 2:
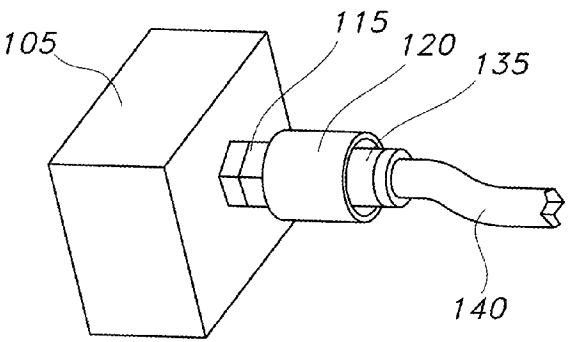
FIG. 2 is a side view of the security system shown in FIG. 1 in which the connector has been connected to the port according to an exemplary embodiment.

Referring now to FIGS. 1 and 2, a security system 100 is illustrated according to an exemplary embodiment. FIG. 1 includes a perspective view of security system 100 illustrating the various components of security system 100 in a disconnected or exploded view. Security system 100 includes a shield 120 (e.g., an axially elongated sleeve or other device configured to cover a connector) and a tool 145 configured to access a connector 125 to tighten, loosen, or remove the connector 125 underneath shield 120.

FIG. 1 illustrates a device 105 having a coaxial cable port 110 for receiving signals over a coaxial cable that is connected to port 110. In one embodiment, device 105 may be a hub having multiple ports that may be configured to allocate and/or route resources over several attached coaxial cables. In other embodiments, device 105 may be a set-top box, television, antenna, computing device, or other type of device configured to receive signals from a coaxial cable via a port. In some embodiments, a sealing member 115 may be placed on the port adjacent to an end (e.g., a threaded end of a nut or fastener portion) of connector 125 to protect the threads and/or to seal the connection and prevent or reduce the migration of moisture.

Connector 125 includes a fastener portion 130 (e.g., a nut portion) and a body portion 135. Fastener portion 130 includes an outer portion (e.g., a nut, such as a nut having a hexagonal shape) configured to be rotated by a hand or tool to rotate fastener portion 130 and a front inner portion having threads for mating with threads of port 110. Body portion 135 is configured to receive a coaxial cable and may include a collapsible portion or other device or mechanism for compressing a coaxial cable 140 into connector 125.

Connector 125 is advanced into shield 120 before it is connected to port 110. Shield 120 protects connector 125 from being connected and/or disconnected from port 110 by limiting the area between connector 125 and shield 120 in which a tool (e.g., a pliers, a wrench, etc.) may be inserted to rotate the outer portion of fastener portion 130. At least a front portion of tool 145 has an inner diameter that is larger than a maximum diameter of body portion 135 of connector 125 and an outer diameter that is smaller than an inner diameter of shield 120, such that the tool can be slid between shield 120 and body portion 135 to access fastener portion 130.

To tighten connector 125 onto port 110, tool 145 may be slid over cable 140 and advanced forward until tool 145 is in contact or engagement with fastener portion 130. Tool 145 may have a slot (e.g., an axial slot) having a diameter larger than a diameter of cable 140 to enable tool 145 to be slid over cable 140. Once tool 145 is advanced forward, a front portion of tool 145 (e.g., teeth, recesses, protrusions, projections, etc.) engage at least a portion of fastener portion 130 (e.g., one or more edges and/or one or more vertices of the nut-shaped outer surface) such that rotation of tool 145 results in corresponding rotation of fastener portion 130. Tool 145 may be rotated in a clockwise direction to cause fastener portion 130 to also rotate in a clockwise direction, causing threads of fastener portion 130 to advance onto the corresponding threads of port 110. FIG. 2 illustrates security system 100 in a configuration where connector 125 has been fully tightened onto port 110. To loosen or remove connector 125 from port 110, tool 145 may be slid between shield 120 and body portion 135 and advanced into engagement with fastener portion 130, then rotated in a counter-clockwise direction, resulting in fastener portion 130 also rotating in the counter-clockwise direction and loosening from port 110.

As illustrated in the exemplary embodiment shown in FIGS. 1 and 2, body portion 135 of connector 125 has an outer diameter that is smaller than the outer diameter of fastener portion 130. For example, body portion 135 has an outer diameter that is smaller than a distance between opposing flat sides of a hexagonal nut portion of fastener portion 130. Some connectors, such as connectors configured to accept a standard dual-shield cable, may have a body portion that is smaller in the radial direction than the fastener portion as shown in FIG. 1. This allows tool 145 to slide over body portion 135 and directly engage (e.g., using teeth, protrusions, etc.) and turn fastener portion 130.

Some connectors, such as certain connectors configured to accept tri-shield or quad-shield cable (e.g., cable having three or four shielding layers), may have body portions that are larger in diameter than the fastener portions of the connectors in at least some angles or configurations. Security system 100 illustrated in FIGS. 1 and 2 may not be used with such a connector because tool 145 may not have an inner diameter large enough to slide over the body portion and still directly engage the fastener portion.

Figure 3:
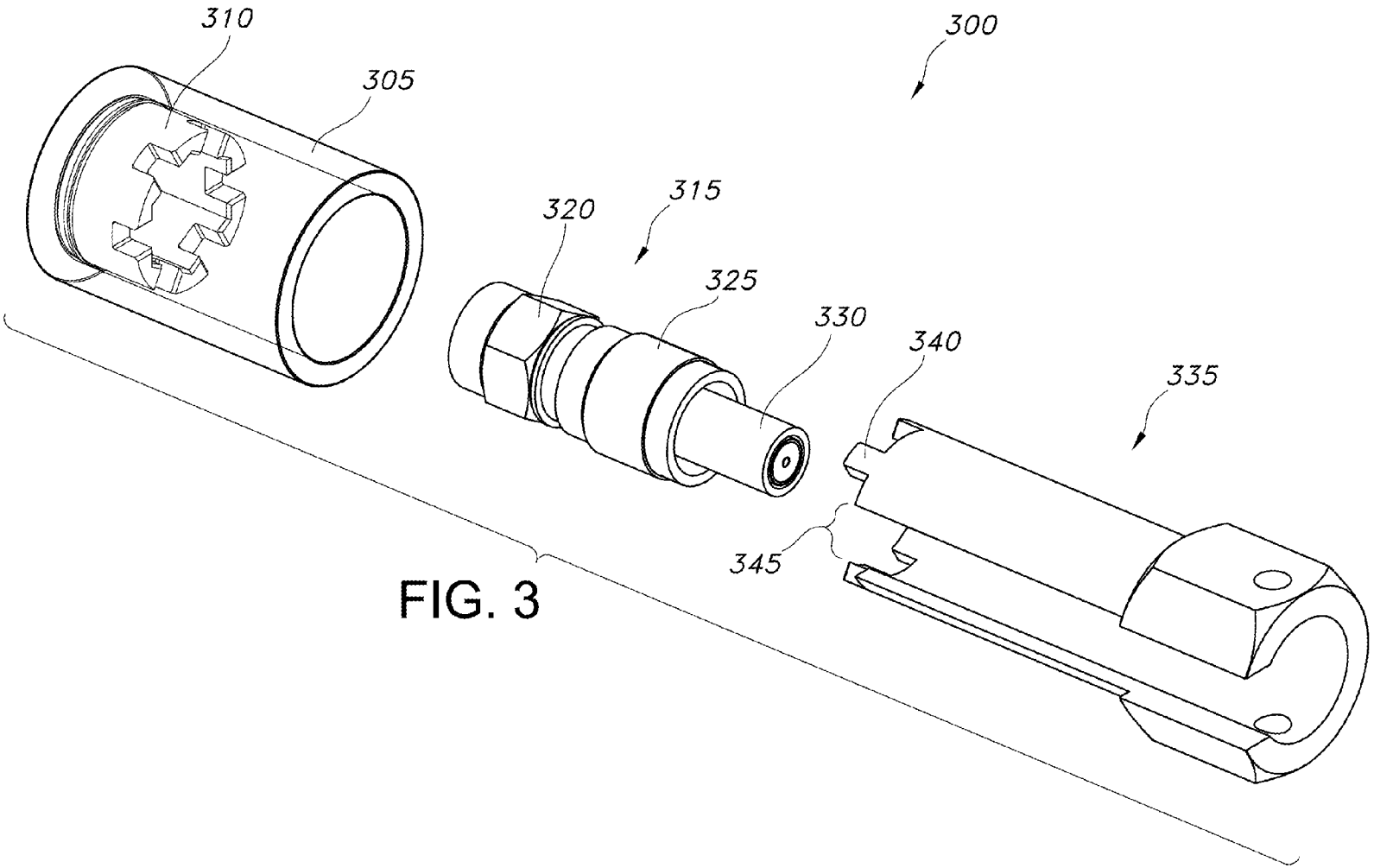
FIG. 3 is a perspective view of a second security system according to an exemplary embodiment.

Referring now to FIG. 3, a perspective view of a second security system 300 is shown according to an exemplary embodiment. Security system 300 includes an adapter 310 configured to engage both a fastener portion 320 of a connector 315 and a front portion of a tool 335 and to operatively couple tool 335 to connector 315 such that rotation of tool 335 causes corresponding rotation of adapter 310, which in turn causes corresponding rotation of fastener portion 320. Security system 300 can be designed for use with connectors regardless of whether or not the body portion of the connectors is larger than the fastener portion of the connectors.

Security system 300 may be used to protect connector 315 against tampering when connected to a port (a port is not illustrated in FIG. 3, but may be substantially similar to port 110 shown in FIG. 1). Connector 315 shown in FIG. 3 includes a fastener portion 320 and a body portion 325 and is configured to electrically connect a coaxial cable 330 to the port. Body 325 may have a maximum outer diameter that is larger than a diameter of fastener portion 320 (e.g., a distance between adjacent flat sides or edges). For example, in one embodiment, a distance between flat edges of the nut portion of fastener 320 may be about 0.433 inches, the outer diameter of body portion 325 may be about 0.485 inches, and the diameter of a circle enclosing the hexagonal nut portion of fastener 320 may be about 0.500 inches. In other embodiments, the outer diameter of body portion 325 may be larger than the diameter of the circle enclosing the hexagonal nut portion of fastener 320. The exemplary security system 300 illustrated in FIG. 3 may be used with any size connector provided the outer diameter of the connector is not larger than the inner diameter of tool 335.

Security system 300 includes an outer shield 305 configured to limit access to connector 315 when attached to a port and an adapter 310 used to tighten and loosen connector 315 from the port. Adapter 310 may be coupled to shield 305 such that, when assembled, adapter 310 is maintained in a substantially constant position (e.g., axial position) with respect to shield 305 but rotates freely with respect to shield 305 (i.e., such that rotation of shield 305 does not result in rotation of adapter 310). Adapter 310 is designed to have a cavity or opening that receives an outer surface of fastener portion 320 of connector 315 and rotationally couples adapter 310 to fastener portion 320, such that rotation of adapter 310 results in corresponding rotation of fastener portion 320. The opening of adapter 310 may be designed to have a substantially similar shape to the corresponding outer surface of fastener portion 320 (e.g., a hexagonal shape) and/or may have a slightly larger diameter than fastener portion 320 (e.g., so that fastener portion 320 fits loosely enough in the opening of adapter 310 that it is easy for a user to advance fastener portion 320 into the opening but fits tightly enough for solid rotational coupling between adapter 310 and fastener portion 320).

Tool 335 may be used to tighten, loosen, and/or remove connector 315 from the port. Tool 335 may tighten or loosen connector 315 by rotating adapter 310, which in turn rotates fastener portion 320 of connector 315. Adapter 310 may include one or more protrusions, projections, teeth, poles, pillars, etc. and/or one or more recesses, slots, holes, openings, etc. configured for use in coupling adapter 310 to tool 335. In some embodiments, the protrusions may extend in an axial direction from a base of adapter 310. In other embodiments, the protrusions may extend in a radial direction outward from adapter 310. Tool 335 may have one or more corresponding protrusions 340 configured to operatively engage the protrusions of adapter 310 and/or to slide within the recesses or slots of adapter 310 to rotationally couple tool 335 to adapter 310, such that rotation of tool 335 causes corresponding rotation of adapter 310. In various embodiments, other methods of rotationally coupling adapter 310 and tool 335 may be used. In some embodiments, a portion (e.g., a rear portion, or portion opposite the end configured to be coupled to adapter 310) of tool 335 may be shaped in a manner designed to enable easy rotation of tool 335 by hand or using another tool, such as a wrench or pliers. For example, in the illustrated exemplary embodiment, tool 335 has a hexagonally shaped end configured to enable easy rotation with a wrench.

To tighten connector 315 onto a port, connector 315 may be advanced forward until at least part of connector 315 (e.g., fastener portion 320) is within shield 305 (e.g., in an axial direction). Advancement of connector 315 continues until an outer surface of fastener portion 320 slides into the corresponding opening of adapter 310 and is rotationally coupled with adapter 310. Tool 335 is slid over cable 330 (e.g., using a slot 345 having a diameter larger than the diameter of cable 330) and advanced forward toward adapter 310. Tool 335 has an inner diameter that is larger than a maximum diameter of body portion 325 and an outer diameter that is smaller than an inner diameter of shield 305. Tool 335 is advanced forward between outer shield 305 and connector 315 until tool protrusions 340 slide into the slots of adapter 310 and/or are engaged with the adapter protrusions, causing rotational coupling of adapter 310 and tool 335. Tool 335 may be rotated in a clockwise direction, causing adapter 310 to rotate in a clockwise direction, which in turn causes fastener portion 320 of connector 315 to rotate in a clockwise direction and thread onto the port. To loosen or remove connector 315 from the port, tool 335 can be turned in a counter-clockwise direction, causing corresponding rotation in adapter 310, which in turn causes corresponding rotation in fastener portion 320.

Figure 4:
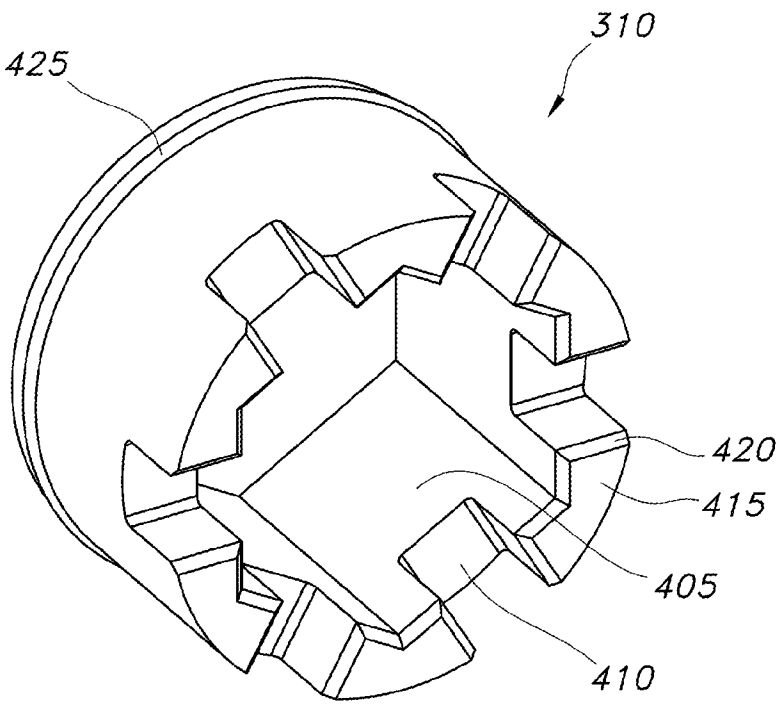
FIG. 4 is a perspective view of the adapter of the security system shown in FIG. 3 according to an exemplary embodiment.

Referring now to FIG. 4, a detailed perspective view of adapter 310 is illustrated according to an exemplary embodiment. As discussed above, adapter 310 may have a nut opening 405 (e.g., an opening, cavity, etc.) formed therein configured to receive a fastener portion of a connector and rotationally couple adapter 310 to the fastener portion of the connector. Adapter 310 may also have one or more slots 410 configured to receive protrusions of a tool and/or one or more adapter protrusions 415 configured to interact with the tool protrusions such that adapter 310 rotates with rotation of the tool. In some embodiments, one or more edges of adapter slots 410 and/or protrusions 415 may be a beveled edge 420 (e.g., an edge that is at a non-perpendicular, or other than 90 degree, angle, such as 30 degrees, 45 degrees, 60 degrees, etc.). Beveled edges may assist the fastener portion of the connector and/or the tool protrusions by more easily shifting into alignment with corresponding portions of adapter 310. Adapter 310 may include an annular slot 425 or ridge configured to interact with a corresponding slot or ridge of the outer shield to hold adapter 310 in substantially constant axial position while allowing adapter 310 to rotate freely with respect to the outer shield. In the exemplary embodiment illustrated in FIG. 4, slots 410 are aligned at about a center of the edges of the fastener portion of the connector and the vertices of the fastener portion are aligned with the adapter protrusions. In the illustrated exemplary embodiment, adapter 310 includes six protrusions and six slots. In other exemplary embodiments, the adapter could include a greater or lesser number of slots and/or protrusions (e.g., three, two, etc.). In some embodiments, using multiple slots and/or protrusions may help increase strength of the adapter and/or tool and reduce the stress applied to any particular protrusion. In some embodiments, the slots and/or protrusions of adapter 310 may be spaced equidistant from one another in a circumferential direction. In other embodiments, the spacing between the slots and/or protrusions may not be uniform.

Figure 5:
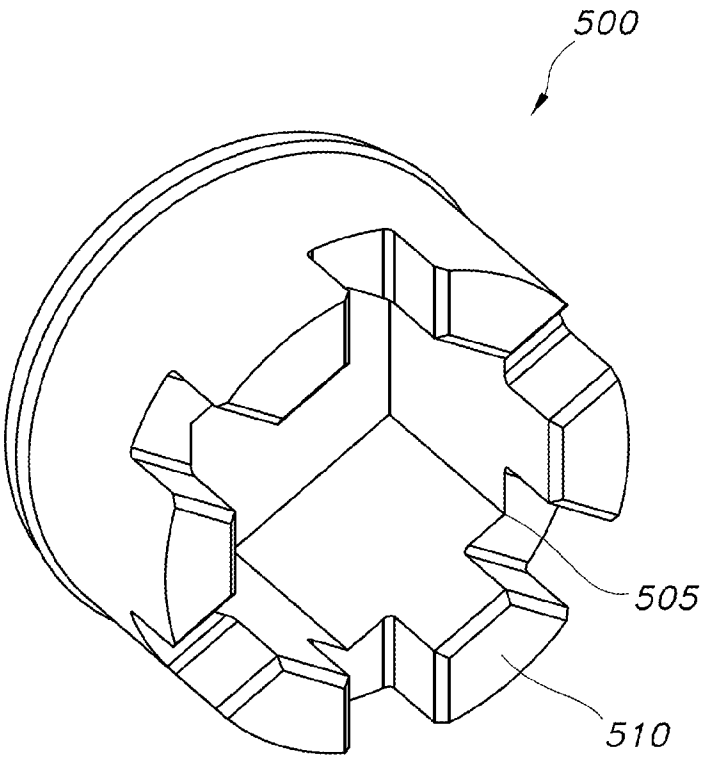
FIG. 5 is a perspective view of another adapter according to an exemplary embodiment.

Referring now to FIG. 5, a detailed perspective view of a second type of adapter 500 is shown according to an exemplary embodiment. Various features of adapter 500 may be substantially similar to those of adapter 310 shown in FIG. 4. Adapter 500 is designed such that the vertices of the fastener portion of the connector, when advanced into adapter 500, are aligned with the slots 505 of adapter 505 and the center of the edges of the fastener portion are aligned with the adapter protrusions 510. Aligning the fastener portion of the connector in the manner illustrated in FIG. 5 may help enable easier alignment of the fastener portion with adapter 500 when advancing the fastener portion into engagement with adapter 500. While various figures disclosed herein include adapter 310, as illustrated, it should be understood that adapter 310 could be replaced with adapter 500 or a similarly modified adapter in any of the disclosed exemplary embodiments.

Figure 6:
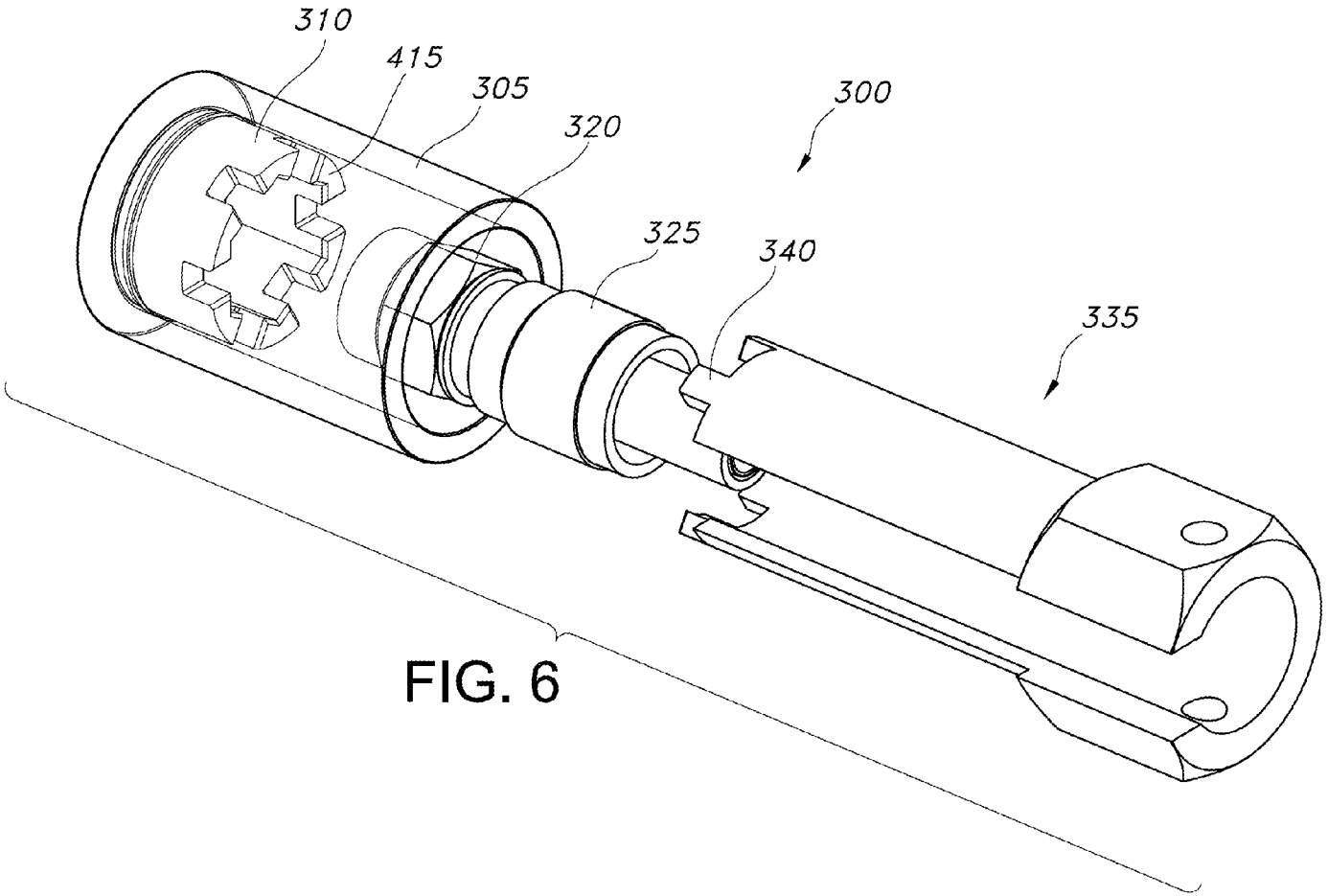
FIG. 6 is a perspective view of the security system of FIG. 3 where the connector is partially advanced into the shield according to an exemplary embodiment.
Figure 7:
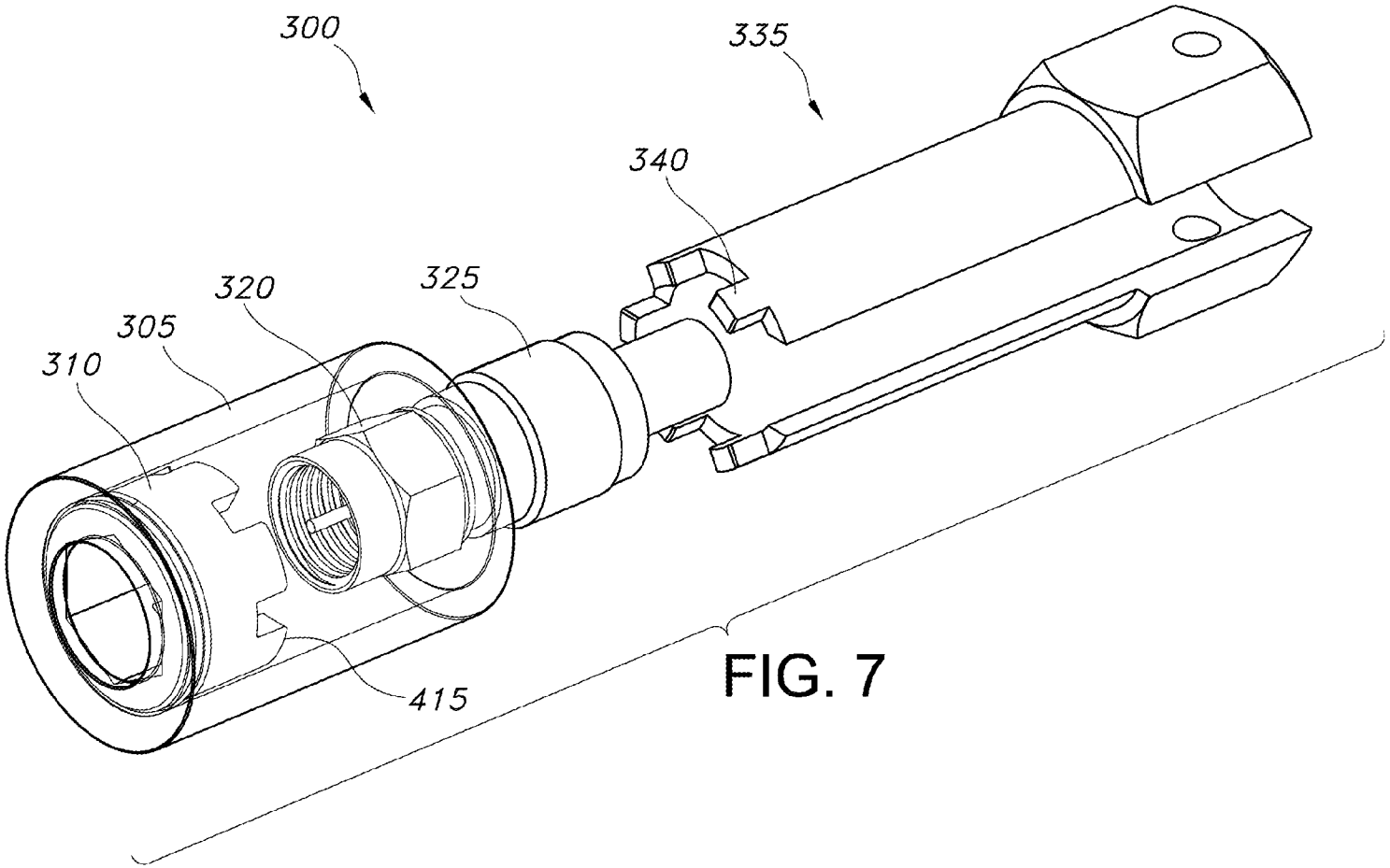
FIG. 7 is another perspective view of the security system of FIG. 3 where the connector is partially advanced into the shield according to an exemplary embodiment.

Referring now to FIGS. 6 and 7, two different perspective views of security system 300 are illustrated according to exemplary embodiments. In FIGS. 6 and 7, connector 315 is shown as being partially advanced into shield 305. Connector 315 may continue to be advanced until fastener portion 320 is in full engagement with adapter 310.

Figure 8:
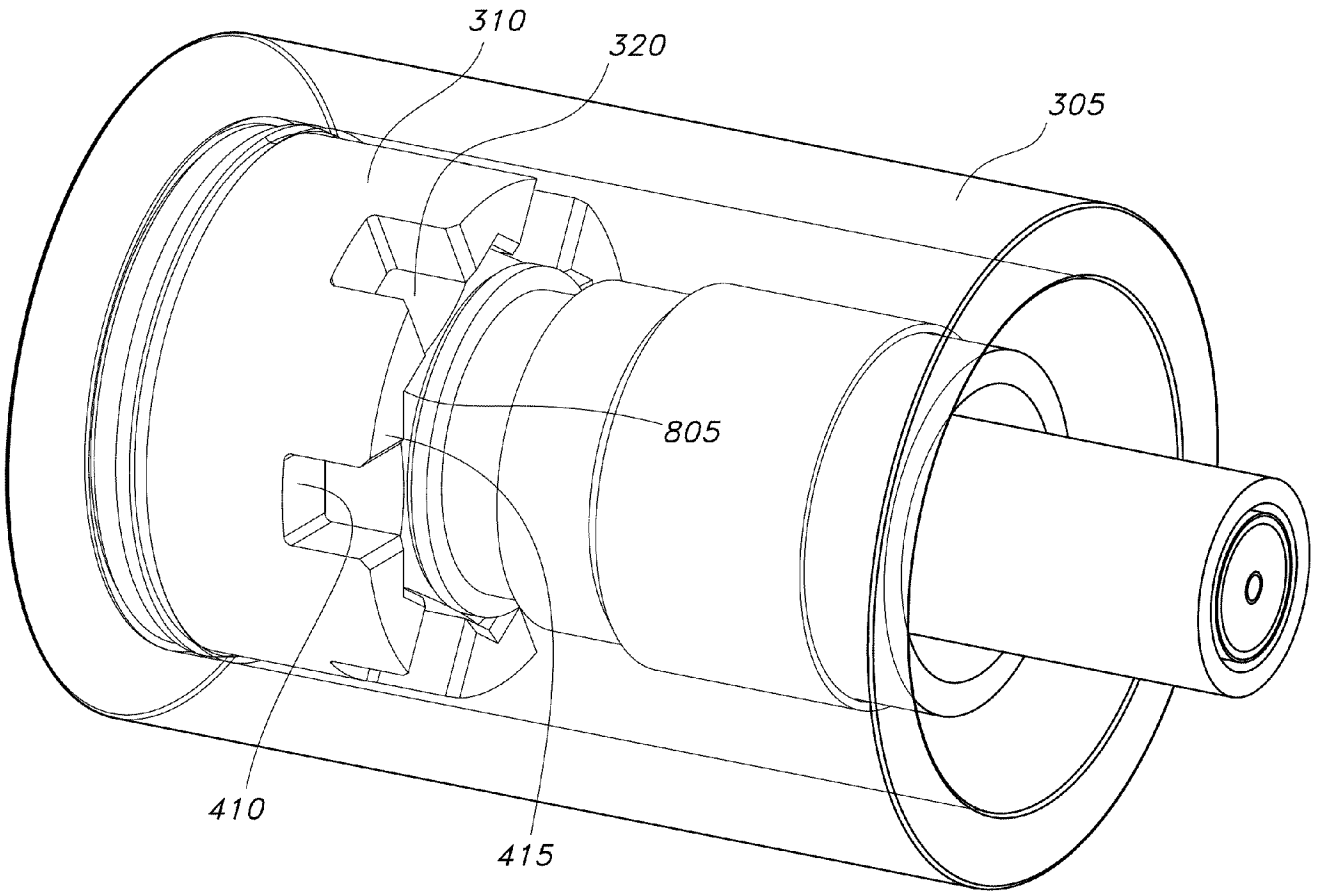
FIG. 8 is a detailed view of the security shield and adapter of FIG. 3 where the connector is fully advanced into engagement with the adapter according to an exemplary embodiment.

FIG. 8 illustrates connector 315, adapter 310 and shield 305 after connector 315 has been advanced until fastener portion 320 is in full engagement with adapter 310 according to an exemplary embodiment. Fastener portion 320 is advanced until it slides into the nut cavity or opening formed in adapter 310. When fully advanced into the opening, vertices or corners of fastener portion 320 slide into corresponding corners of the inner walls of adapter 310, and edges of fastener portion 320 slide against corresponding flat portions of adapter 310.

Figure 9:
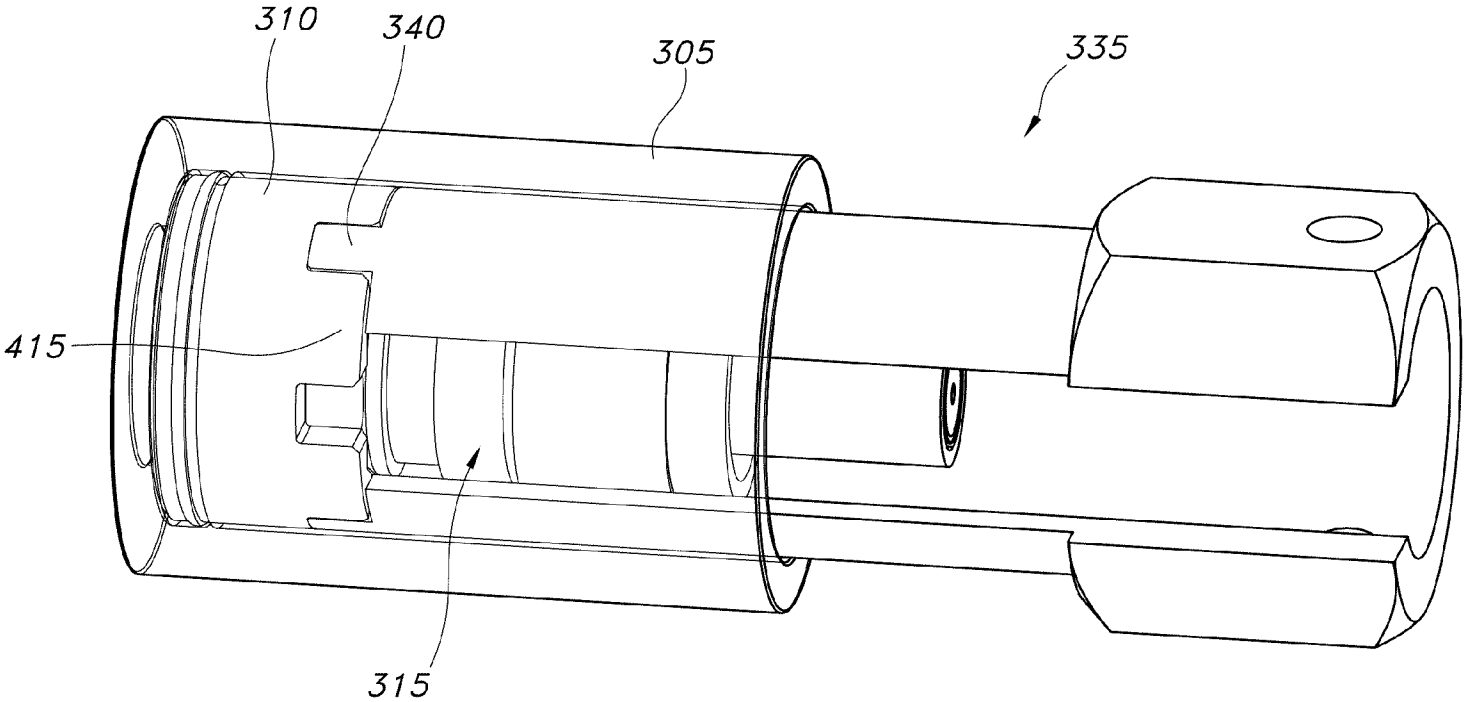
FIG. 9 is a side view of the security system of FIG. 3 where the connector and tool are both fully advanced into engagement with the adapter according to an exemplary embodiment.

FIG. 9 includes a side view illustrating security system 300 in a configuration in which both connector 315 and tool 335 are fully engaged with adapter 310. In the illustrated exemplary embodiment, fastener portion 320 of connector 315 has been fully advanced into the nut opening of adapter 310 (e.g., as shown in FIG. 8). Tool 335 has also been slid forward between shield 305 and connector 315 until tool protrusions 340 are placed into the adapter slots and are rotationally engaged with adapter protrusions 415. In the configuration shown in FIG. 9, rotating tool 335 in a clockwise direction (e.g., to the right) causes tool protrusions 340 to exert force against adapter protrusions 415, in turn causing adapter 310 to rotate in the clockwise direction. The inner walls abutting the nut opening of adapter 310 then exert force against the corresponding outer surface of fastener portion 320 of connector 315, causing fastener portion 320 to turn in the clockwise direction as well and tighten onto a port. Similar corresponding forces between tool 335, adapter 310, and fastener portion 320 result when turning tool 335 counter-clockwise to loosen and/or remove connector 315 from the port.

Figure 10:
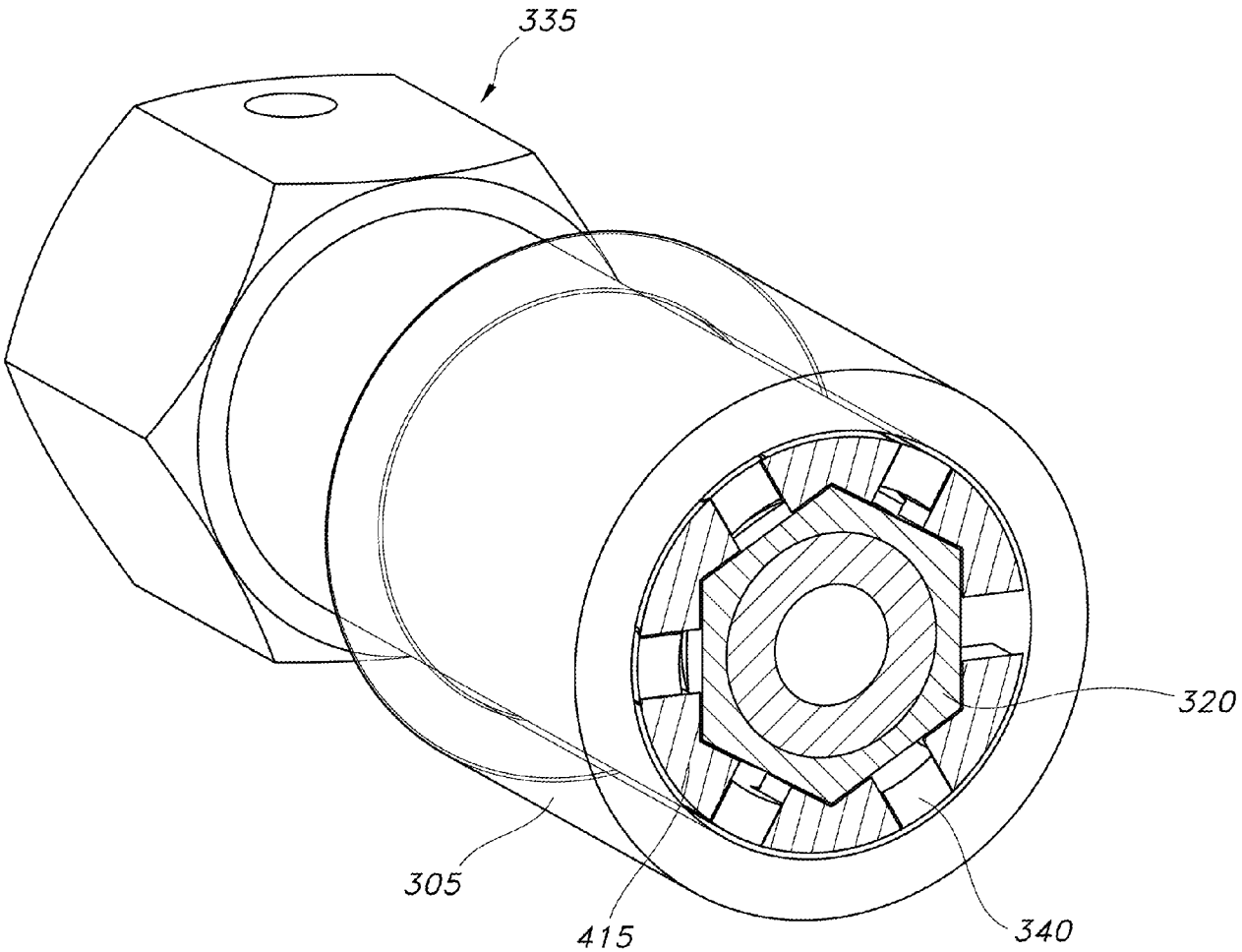
FIG. 10 is a cross-sectional view of the security system of FIG. 3 where the connector and tool are both fully advanced into engagement with the adapter according to an exemplary embodiment.

Referring now to FIG. 10, a cross-sectional view of security system 300 in the fully engaged configuration (e.g., as shown in FIG. 9) is shown according to an exemplary embodiment. FIG. 10 illustrates a partial cut-away view of shield 305, adapter 310, fastener portion 320 of connector 315, and tool 335 at a point illustrating engagement of the components to one another. Tool protrusions 340 are rotationally engaged with adapter protrusions 415. Fastener portion 320 of connector 315 is fully advanced into the nut opening or cavity of adapter 310 and is rotationally engaged with the inner walls of adapter 310.

Figure 11:
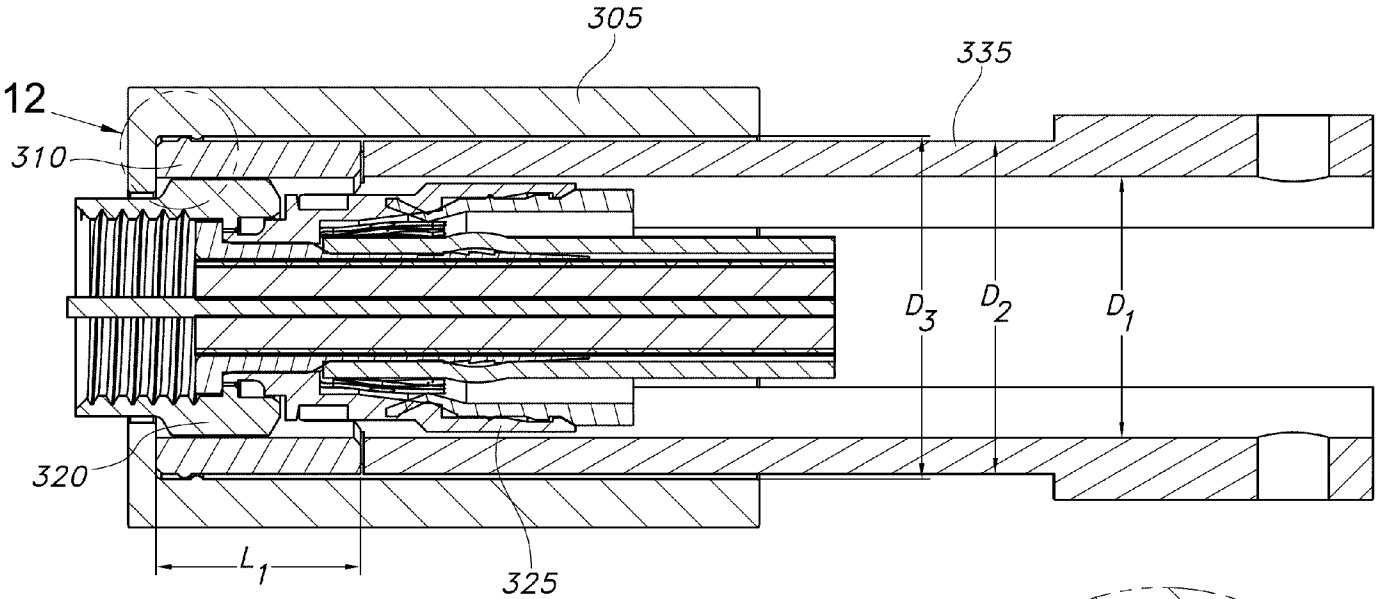
FIG. 11 is another cross-sectional view of the security system of FIG. 3 where the connector and tool are both fully advanced into engagement with the adapter according to an exemplary embodiment.

Referring now to FIG. 11, a different cross-sectional view of security system 300 in the fully engaged configuration (e.g., as shown in FIGS. 9 and 10) is shown according to an exemplary embodiment. Protrusions of tool 335 are advanced into slots and rotationally engaged with protrusions of adapter 310. An outer surface of fastener portion 320 is abutting and in rotational engagement with an inner wall or surface of adapter 310. Length L1 represents an axial length of adapter 310 (including the adapter protrusions). As discussed above, an out diameter D2 of tool 335 is smaller than an inner diameter D3 of shield 305, and an inner diameter D1 of tool 335 is larger than the maximum diameter of connector 315 (and, more specifically in this exemplary embodiment, body 325).

Figure 12:
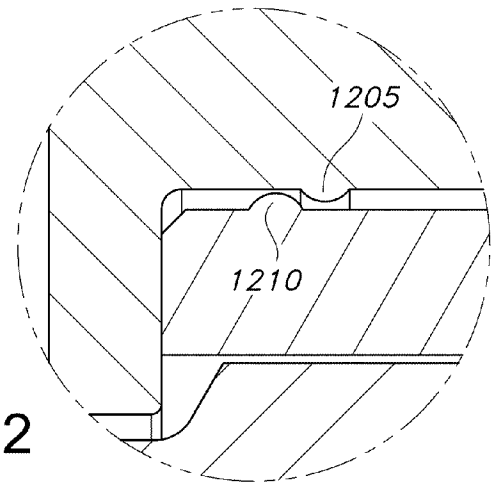
FIG. 12 is a detailed view illustrating the coupling of the adapter and security shield of FIG. 11 according to an exemplary embodiment.

FIG. 12 includes a detailed view of a portion of FIG. 11 illustrating a coupling configuration of adapter 310 and shield 305. In the illustrated exemplary embodiment, adapter 310 includes a ridge 1210 or bump on its outer surface that is raised (e.g., has a larger diameter in a radial direction) in comparison with adjacent portions of the base of adapter 310. Shield 305 also has a ridge 1205 or bump on its inner surface or wall that protrudes further inwards (e.g., has a smaller inner diameter in the radial direction) than adjacent portions of shield 305. To assemble adapter 310 with shield 305, adapter 310 may be advanced into shield 305 until ridge 1210 passes under ridge 1205 (e.g., snaps into place). Together, ridges 1205 and 1210 hold adapter 310 in a substantially constant axial position with respect to shield 305 while allowing adapter 310 to rotate independently of shield 305.

In some embodiments, a method of securing a coaxial cable connector may include providing an outer shield configured to limit access to the coaxial cable connector. The coaxial cable connector comprises a fastener portion that is configured to be rotatable with respect to a body portion of the coaxial cable connector. The method may further include providing an adapter configured to be coupled to the outer shield. The adapter has a cavity formed therein into which the fastener portion of the coaxial cable connector can be advanced such that rotation of the adapter causes corresponding rotation of the fastener portion of the coaxial cable connector. The adapter comprises a plurality of adapter projections. The method may further include providing a tool comprising a hollow cylindrical portion and a plurality of tool projections extending axially from an end of the hollow cylindrical portion. The tool is configured to be moved between the outer shield and the coaxial cable connector in an axial direction until the tool projections are inserted between the adapter projections. The tool is configured to rotate the adapter through rotation of the tool projections against the adapter projections.

In various embodiments, various components of the security systems disclosed herein, such as the shield, adapter, and/or tool, may be constructed from a durable and/or inexpensive material such as plastic, metal (e.g., brass), etc. In some embodiments, the tool and/or adapter may be constructed from plastic to limit the torque that could be applied by a user to the connector (e.g., to avoid damaging the connector and/or port). In some embodiments, the shield, adapter, and/or tool may be injection-molded.

It should be noted that the various features discussed herein with respect to the embodiments shown in the FIGURES may be used alone, or in combination, and all such features and combinations of features are within the scope of the present disclosure.

For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. Such joining may also relate to mechanical, fluid, or electrical relationship between the two components.

It is important to note that the construction and arrangement of the elements of the coaxial cable connectors as shown in the exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the embodiments. Accordingly, all such modifications are intended to be included within the scope of the present disclosure as defined in the appended claims. The order or sequence of any process or method steps may be varied or re-sequenced according to alternative embodiments. Other substitutions, modifications, changes, and/or omissions may be made in the design, operating conditions, and arrangement of the exemplary embodiments without departing from the spirit of the present disclosure.

What is claimed is:

1. A shield for use with a coaxial cable connector, comprising:

an outer shield configured to limit access to the coaxial cable connector, wherein the coaxial cable connector comprises a fastener portion that is configured to be rotatable with respect to a body portion of the coaxial cable connector; and an adapter configured to be coupled to the outer shield, wherein the adapter is configured to engage a surface of the fastener portion of the coaxial cable connector, wherein the adapter is further configured to engage a tool configured to rotate the adapter such that, when engaged with both the tool and the fastener portion of the coaxial cable connector, the adapter is configured to rotate the fastener portion of the coaxial cable connector upon rotation of the adapter by the tool.

2. The shield of claim 1, wherein the adapter comprises one or more adapter protrusions configured to be operatively coupled with one or more tool protrusions of the tool to rotate the adapter.

3. The shield of claim 2, wherein the adapter comprises one or more recesses positioned between the one or more adapter protrusions and configured to accept the one or more tool protrusions when the tool is engaged with the adapter.

4. The shield of claim 3, wherein the adapter protrusions each comprise at least one edge that is at least partially beveled.

5. The shield of claim 2, wherein the adapter has a hexagonal cavity formed therein having a diameter slightly larger than a diameter of the fastener portion of the coaxial cable connector, and wherein the fastener portion slides into the hexagonal cavity when the coaxial cable connector is mated with the adapter.

6. The shield of claim 4, wherein the hexagonal cavity comprises six edges and six vertices, wherein the adapter comprises six adapter protrusions, and wherein each of the six adapter protrusions is circumferentially aligned with a center for an edge of the hexagonal cavity.

7. The shield of claim 1, wherein the fastener comprises a hexagonal nut portion having six flat edges, wherein the six flat edges comprise three pairs of edges, each pair of edges being disposed opposite from one another on the hexagonal nut portion, wherein the coaxial cable connector comprises a second portion having an outer diameter that is greater than a distance between opposite flat edges of the hexagonal nut portion, and wherein the outer shield has an inner diameter that is greater than the outer diameter of the second portion.

8. The shield of claim 1, wherein the adapter is configured to be coupled to the outer shield in a manner such that the adapter is maintained in a substantially constant axial position with respect to the outer shield and rotates independently of the outer shield during use.

9. A tool for connecting and disconnecting a coaxial cable connector protected by a security shield from a port, wherein the security shield comprises a sleeve and an adapter having a plurality of adapter protrusions and a plurality of adapter slots between the adapter protrusions, wherein the adapter has an opening formed therein into which a fastener portion of the coaxial cable connector fits such that, when the fastener portion is placed into the opening of the adapter, rotation of the adapter causes corresponding rotation of the fastener portion of the coaxial cable connector, wherein the tool comprises:

a body comprising a cylindrical portion at least partially surrounding a hollow cylindrical cavity, wherein the body comprises an inner tool diameter that is greater than a maximum diameter of the coaxial cable connector and an outer tool diameter that is less than a inner diameter of the sleeve of the security shield; and a plurality of tool protrusions extending axially from an end of the body, wherein each of the tool protrusions is configured to fit within one of the adapter slots;

wherein the tool is configured to be moved between the sleeve and the coaxial cable connector in an axial direction until the tool protrusions are inserted into the adapter slots, and wherein the tool is configured to rotate the adapter through rotation of the tool protrusions against the adapter protrusions.

10. The tool of claim 8, wherein the tool comprises at least three tool protrusions.

11. The tool of claim 8, wherein the plurality of tool protrusions are spaced equidistant from one another in a circumferential direction.

12. The tool of claim 8, further comprising an axial slot formed in the body having an axial slot diameter that is larger than a diameter of a quad shield cable.

13. A security system for use with a coaxial connector, comprising:

an outer shield configured to limit access to the coaxial cable connector, wherein the coaxial cable connector comprises a fastener portion that is configured to be rotatable with respect to a body portion of the coaxial cable connector; and an adapter configured to be coupled to the outer shield, wherein the adapter has a cavity formed therein into which the fastener portion of the coaxial cable connector can be advanced such that rotation of the adapter causes corresponding rotation of the fastener portion of the coaxial cable connector, and wherein the adapter comprises a plurality of adapter projections;

a tool comprising a hollow cylindrical portion and a plurality of tool projections extending axially from an end of the hollow cylindrical portion, wherein the tool is configured to be moved between the outer shield and the coaxial cable connector in an axial direction until the tool projections are inserted between the adapter projections, and wherein the tool is configured to rotate the adapter through rotation of the tool projections against the adapter projections.

14. The security system of claim 13, wherein the adapter comprises one or more recesses positioned between the one or more adapter projections and configured to receive the one or more tool projections when the tool is moved into engagement with the adapter.

15. The security system of claim 14, wherein the adapter protrusions each comprise at least one edge that is at least partially beveled.

16. The security system of claim 13, wherein cavity of the adapter has a hexagonal shape.

17. The security system of claim 16, wherein the hexagonal cavity comprises six edges and six vertices, wherein the adapter comprises six adapter projections, and wherein each of the six adapter projections is circumferentially aligned with a center for an edge of the hexagonal cavity.

18. The security system of claim 13, wherein the fastener comprises a hexagonal nut portion having six flat edges, wherein the six flat edges comprise three pairs of edges, each pair of edges being disposed opposite from one another on the hexagonal nut portion, wherein the coaxial cable connector comprises a second portion having an outer diameter that is greater than a distance between opposite flat edges of the hexagonal nut portion, and wherein the outer shield has an inner diameter that is greater than the outer diameter of the second portion.

19. The security system of claim 13, wherein the adapter is configured to be coupled to the outer shield in a manner such that the adapter is maintained in a substantially constant axial position with respect to the outer shield and rotates independently of the outer shield during use.

20. The security system of claim 13, wherein the adapter projections are spaced equidistant from one another in a circumferential direction, and wherein the tool projections are spaced equidistant from one another in the circumferential direction.

* * * * *